US007789765B2

(12) United States Patent
Marini

(10) Patent No.: US 7,789,765 B2
(45) Date of Patent: Sep. 7, 2010

(54) GOLF TRAINING AID FOR PENDULUM PUTTING MOTION AND ACCEPTED CHIPPING MOTION

(76) Inventor: John Joseph Marini, 2349 Beverly St., Oviedo, FL (US) 32765

( * ) Notice: Subject to any disclaimer, the term of this patent is extended or adjusted under 35 U.S.C. 154(b) by 0 days.

(21) Appl. No.: 12/367,793

(22) Filed: Feb. 9, 2009

(65) Prior Publication Data

US 2009/0203459 A1 Aug. 13, 2009

Related U.S. Application Data

(60) Provisional application No. 61/065,035, filed on Feb. 8, 2008.

(51) Int. Cl.
*A63B 69/36* (2006.01)

(52) U.S. Cl. ..... 473/226; 473/206; 473/239; 473/409

(58) Field of Classification Search ..... 473/206, 473/226, 227, 238, 266, 276, 277, 298, 299, 473/409, 239; 285/80, 89, 249, 255, 400, 285/415, 421

See application file for complete search history.

(56) References Cited

U.S. PATENT DOCUMENTS 2,801,875 A * 8/1957 McEvoy ..... 294/19.2
5,024,438 A 6/1991 Candow
5,156,401 A 10/1992 Hodgkiss
5,282,619 A 2/1994 Napolitano
5,390,921 A 2/1995 De Ruyter
5,531,446 A 7/1996 Scheie
5,649,870 A 7/1997 Harrison
5,839,972 A * 11/1998 Swanson ..... 473/286
6,196,930 B1 3/2001 Aumock
6,296,577 B1 * 10/2001 Trammell et al. ..... 473/340
7,147,568 B1 * 12/2006 Butler ..... 473/239
7,422,526 B2 * 9/2008 Nemeckay ..... 473/296
2003/0207723 A1 * 11/2003 Jacoby ..... 473/298
2004/0048679 A1 * 3/2004 Bunting ..... 473/226

* cited by examiner

*Primary Examiner*—Nini Legesse
(74) *Attorney, Agent, or Firm*—Craig E. Bohn

(57) ABSTRACT

A golf training aid comprised of a telescopic rod mounted on an adjustable bracket and a generally spherical end member mounted on the rod. The bracket adjusts to fit over the end of the grip of a golf club and is held in place by a band around the bracket. The rod is adapted to be extended and shortened as a means to adjust the length of the device. The distance of the end member from the grip is adjusted so that the end member contacts the midsection of a golfer when he assumes his putting stance and is positioned outside the golfer's body when used for chipping. The portion of the end member which contacts a golfer's body has relatively low friction so that the end member moves relative to the body if the proper putting stroke is not used. The telescopic rod of the device is not meant to contact the golfer's body when used for chipping and will come in contact with the golfer's body when an improper chipping motion is used.

16 Claims, 2 Drawing Sheets

GOLF TRAINING AID FOR PENDULUM PUTTING MOTION AND ACCEPTED CHIPPING MOTION

CROSS-REFERENCE TO RELATED APPLICATIONS

This application claims the benefit of provisional patent application No. 61/065,035, filed 8 Feb. 2008 by the present inventor.

STATEMENT REGARDING FEDERALLY SPONSORED RESEARCH OR DEVELOPMENT

Not Applicable

BACKGROUND OF THE INVENTION

1. Field of the Invention

The field of this invention relates to golf training devices and more particularly to a device which is designed to improve the putting and chipping of a golf ball during the playing of the game of golf.

2. Description of the Related Art

The current device relates to golf training aids, and more particularly, to a putting aid which promotes a pendulum putting stroke and a chipping aid which promotes a consistent chipping motion. A golf training aid is a device which is used during practice to promote a desired stroke. Golf training aids are usually not a permanent part of the golf club and are usually not allowed during competition.

A pendulum-like putting stroke, which has been found to be very effective, is one in which the butt end of the putter points toward the golfer's midsection throughout the duration of the stroke, as if having a fixed point of attachment to the belly. Although several training aids have been developed with the intent of producing such a stroke, these aids are limited in their effectiveness mainly because they are focused on the movement of the arms and shoulders rather than the putter head in relation to the handle. A proper chipping motion, accepted by most credible teachers of the game of golf, is one in which the hands of the golfer remain ahead of the golf ball at impact and in which the wrists do not break down and no scooping motion is employed.

One prior golf training aid is U.S. Pat. No. 5,531,446, in which Scheie et al. disclose a golfer's putting aid having an elongated rod with a spherical end member. The rod is slidably inserted through an opening in the end of the putter's grip and relies on the pliable material of the grip to retain its position. This configuration does not provide enough resistance and strength to give a very firm hold on the rod insert.

Another device that closely resembles this new invention is U.S. Pat. No. 6,196,930, in which Aumock discloses a Golf club extension apparatus to demonstrate to a user that the user's chipping motion is either correct or incorrect. This device is useful for chipping, but is not adjustable in length and cannot be used as an aid for putting.

Other golf training aids designed to improve putting and chipping include:

U.S. Pat. No. 5,156,401 to Hodgkiss discloses a T-shaped putting training device having a stem secured to the handle end of a golf club shaft. A cross-piece abuts the user's chest with its end portions extending behind the user's arms.

U.S. Pat. No. 5,024,438 to Candow discloses a golf putter extension to allow the golf putter to be used in a pendulum type manner.

U.S. Pat. No. 5,282,619 to Napolitano et al. discloses a practice golf club having three telescoping sections.

U.S. Pat. No. 5,390,921 to De Ruyter discloses a tubular golf club shaft extension element. The grip is positioned at the outer end of the extension element. The extension simply makes a golf club shaft longer, with the grip at the outer end of the extension.

U.S. Pat. No. 5,649,870 to Harrison discloses a golf club putter extension to enable the putter to be used with the pendulum type stroke.

BRIEF DESCRIPTION OF THE DRAWINGS

The invention will be explained in conjunction with an illustrative embodiment shown in the accompanying drawings, in which.

DESCRIPTION OF THE ILLUSTRATED EMBODIMENT

Figure 1:
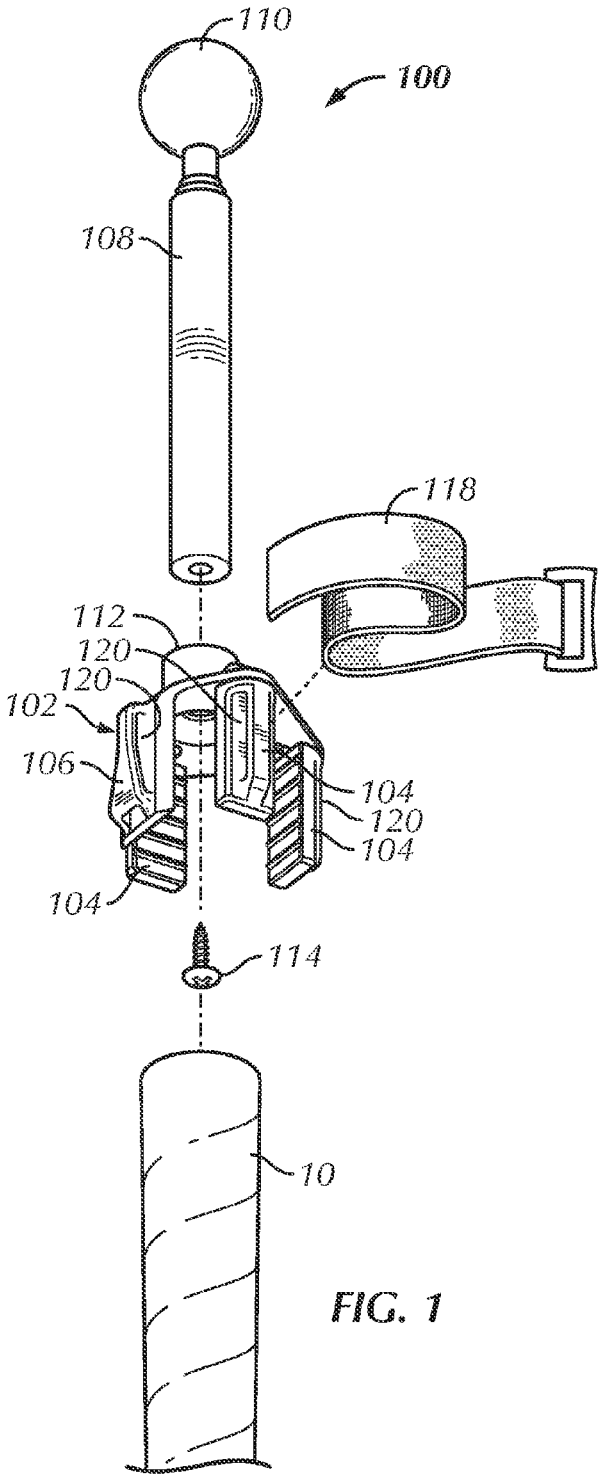
FIG. 1 is an exploded perspective view of the golf training aid and the grip of a golf club.
Figure 2:
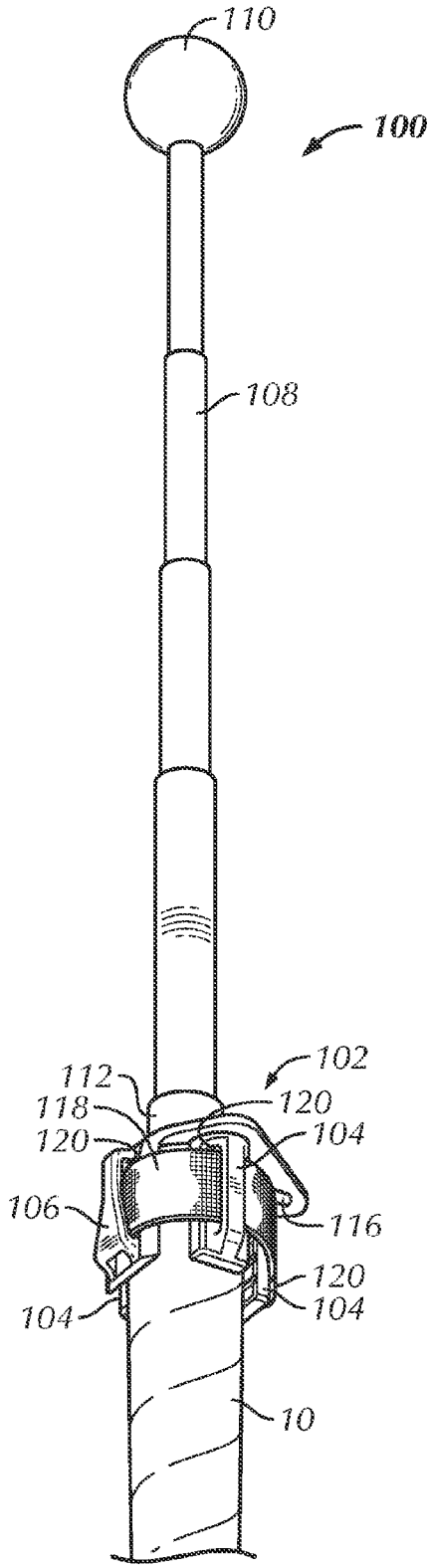
FIG. 2 is a perspective view of the golf training aid attached to a golf club and telescopically extended.

Now, referring to FIGS. 1 and 2, the exemplary golf training aid 100 is comprised of a bracket 102 that is the attachment point to a conventional golf club grip 10. The exemplary bracket 102 is comprised of a fixed finger 106 and three movable fingers 104. The fixed finger 106 and the movable fingers 104 extend from one side of the bracket 102. The movable fingers 104 slidably move along small channels 116 to adjust to the size and shape of the golf club grip 10. When affixed the fingers each lay normal to the surface of the golf club grip 10 and are held securely in place by a cinch strap 118. The exemplary cinch strap 118 wraps around the fingers (104, 106), being threaded through eyelets 120 in the side of the fingers (104, 106) distal to the surface that is to contact the golf club grip 10, and secure with an integrated hook and loop fastening system. A telescopic rod 108 is affixable to the bracket 102, being inserted into a sleeve 112. The exemplary sleeve 112 extends from the side of the bracket 102 opposite to the fingers (104, 106). The exemplary telescopic rod 108 has a spherical end 110 distal the end that attaches to the bracket 102. The rod 108 is attached to the bracket 102 by a screw 114 that is threadably secured into the end of the rod 108, distal to the spherical end 110, from the side of the bracket 102 from which the fingers (104, 106) extend.

In alternate exemplary embodiments, the golf training aid 100 may have differing numbers of fingers (104, 106) arranged around the general periphery of the bracket 102. It is also envisioned that the exemplary cinch strap 118 may be supplanted by other forms of retaining devices or an affixing member integrated into one or more of the fingers (104, 106).

Figure 3:
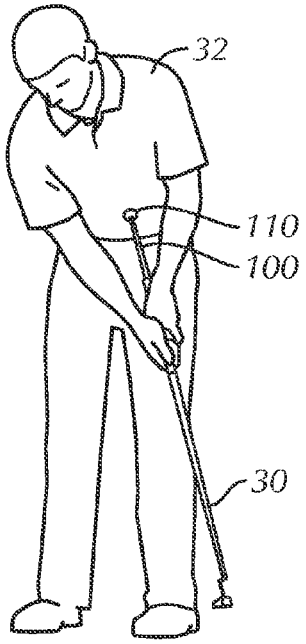
FIG. 3 is an illustration of the golf training aid being used while a golfer executes a putting stroke.
Figure 4:
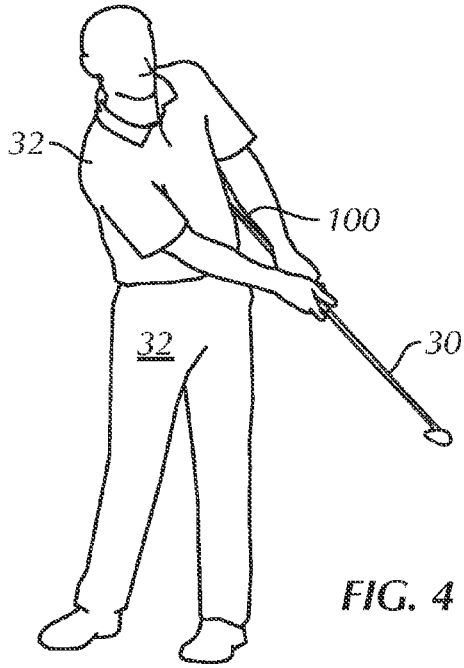
FIG. 4 is an illustration of the golf training aid being used while a golfer executes a chipping motion.

In use the golf training aid 100 promotes a pendulum putting stroke and a consistent chipping motion. The golf training aid 100 can be used with substantially all golf clubs regardless of the size or shape of the grip and can be used with the golfer's normal stance, grip, and set-up. Referring to FIG. 3, when used for putting, the distance of the end 110 from the bracket 102 is adjusted so that the end 110 contacts the body of the golfer 32 when the golfer 32 assumes a putting stance. If the golfer 32 correctly executes a pendulum stroke, the end 110 remains in contact with the body at a fixed point on the stomach assumed at address. If the golfer 32 does not execute a pendulum stroke, the end 110 moves out of contact with the fixed point on the stomach and indicates an error. Referring to FIG. 4, when used for chipping, the rod 108 is fully extended and when the proper chipping motion is employed the device remains harmlessly outside of the user's body, but if an improper chipping motion is used, the rod 108, or end 110 (not shown in FIG. 4), of the golf training aid comes in contact with the golfer's hip or torso, alerting them an incorrect motion has been employed.

FIG. 3 illustrates a golfer 32 making a pendulum putting stroke using the golf training aid 100 attached to a golf club 30 which is in this instance is a putter. The end 110 of the golf training aid 100 is lightly touching the midsection of the golfer 32 so as to create a pendulum point.

FIG. 4 illustrates a golfer 32 using the golf training aid 100 for chipping. The golf training aid 100 is attached to a golf club 30 and in this instance is designed to remain outside the body of the golfer 32. If an incorrect motion is made, the golf training aid 100 will come in contact with the hip or waist of the golfer 32.

Figure 5:
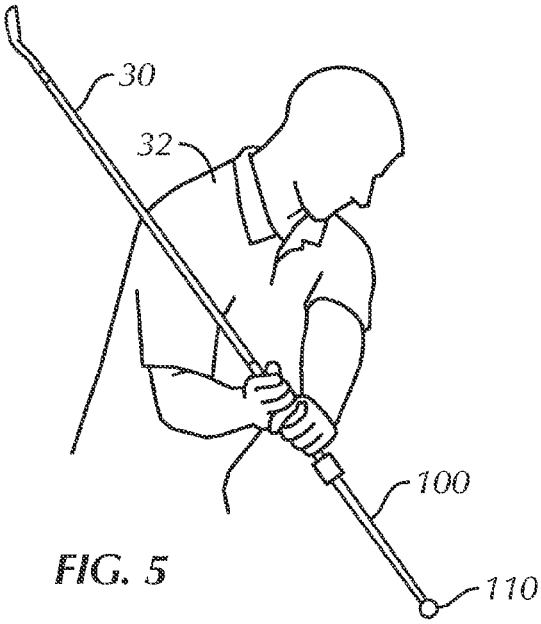
FIG. 5 is an illustration of the golf training aid being used as an extension to show the plane on which the club is positioned.

FIG. 5 illustrates a golfer 32 using the golf training aid 100 for a standard full swing to check the plane of the golf club on a backswing. The golf training aid 100 is attached to a golf club 32 and extends the axis of the shaft and provides a visual reference as to the position of the plane on which the club is positioned.

An exemplary embodiment of the golf training apparatus may include a bracket having a golf club grip attachment side, a plurality of fingers extending from the golf club grip attachment side and positioned generally at the periphery of the bracket, a cinch strap wrappable around the fingers to provide securement to a golf club grip, and a rod attachable to and extending perpendicularly from the bracket opposite the golf club grip attachment side. Alternatively or additionally, such a golf training apparatus may include that the rod is telescopically extendable in length perpendicular to the bracket. Alternatively or additionally, such a golf training apparatus may include that the rod is adjustably extendable in length perpendicular to the bracket. Alternatively or additionally, such a golf training apparatus may include that the plurality of fingers further comprises at least one movable finger and at least one fixed finger, and the movable finger slidably attached to the bracket in order to be adjustably spaced from the other of the plurality of fingers. Alternatively or additionally, such a golf training apparatus may include that the plurality of fingers further comprises two movable finger and two fixed finger, and each movable finger slidably attached to the bracket in order to be adjustably spaced from the general center of the bracket. Alternatively or additionally, such a golf training apparatus may include that the plurality of fingers further comprises one movable finger and two fixed finger, and the movable finger slidably attached to the bracket in order to be adjustably spaced from the general center of the bracket. Alternatively or additionally, such a golf training apparatus may include that a knob may be affixable to the telescopic rod distal the mounting bracket. Alternatively or additionally, such a golf training apparatus may include that the knob is generally spherical. Alternatively or additionally, such a golf training apparatus may include that the plurality of fingers having a grip contact side and an exterior side, at least one of the plurality of fingers having an eyelet on the exterior side, and the cinch being engagable with the eyelet. Alternatively or additionally, such a golf training apparatus may include that the cinch further comprises a hook and loop fastening system.

An exemplary embodiment of a method of developing a pendulum putting stroke in a golfer comprises the step of affixing a golf training apparatus to a golf putter, wherein the golf training apparatus comprises a bracket having a golf club grip attachment side, a plurality of fingers extending from the golf club grip attachment side and positioned generally at the periphery of the bracket, a cinch strap wrappable around the fingers to provide securement to a golf club grip, and a rod attachable to and extending perpendicularly from the bracket opposite the golf club grip attachment side. The method further includes the steps of causing the golfer to grip the golf putter in a conventional manner for putting, extending the rod to contact a center area of the golfer's stomach while in a preparatory putting position, and causing the golfer to make a putting motion while maintaining the rod's contact with the golfer's stomach. This method may be used with a golf training apparatus embodying the various elements described above.

An exemplary embodiment of a method of developing a chipping swing in a golfer comprising the step of affixing a golf training apparatus to a golf club, wherein the golf training apparatus comprises a bracket having a golf club grip attachment side, a plurality of fingers extending from the golf club grip attachment side and positioned generally at the periphery of the bracket, a cinch strap wrappable around the fingers to provide securement to a golf club grip, and a rod attachable to and extending perpendicularly from the bracket opposite the golf club grip attachment side, causing the golfer to grip the golf club in a conventional manner for chipping, extending the rod to a length past the golfer's elbow while in a preparatory chipping position, and causing the golfer to make a chipping motion while avoiding contacting the rod with the golfer's torso. This method may be used with a golf training apparatus embodying the various elements described above.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A golf training apparatus comprising:

a bracket having a golf club grip attachment side;

a plurality of fingers extending from the golf club grip attachment side and positioned generally at a periphery of the bracket;

a cinch strap wrappable around the fingers to provide securement to a golf club grip at least one movable finger and at least one fixed finger; and the movable finger slidably attached to the bracket in order to be adjustably spaced from the at least one fixed finger.

2. The golf training apparatus of claim 1 wherein the plurality of fingers further comprises:

two movable finger and two fixed finger; and each movable finger slidably attached to the bracket in order to be adjustably spaced from a general center of the bracket.

3. The golf training apparatus of claim 1 wherein the plurality of fingers further comprises:

one movable finger and two fixed finger; and the movable finger slidably attached to the bracket in order to be adjustably spaced from a general center of the bracket.

4. The golf training apparatus of claim 1 further comprising:

the plurality of fingers having a grip contact side and an exterior side;

at least one of the plurality of fingers having an eyelet on the exterior side; and the cinch being engagable with the eyelet.

5. The golf training apparatus of claim 1 wherein the cinch further comprises a hook and loop fastening system.

6. The golf training apparatus of claim 1 further comprising a rod attachable to and extending perpendicularly from the bracket opposite the golf club grip attachment side.

7. The golf training apparatus of claim 6 wherein the rod is telescopically extendable in length perpendicular to the bracket.

8. The golf training apparatus of claim 6 wherein the rod is adjustably extendable in length perpendicular to the bracket.

9. The golf training apparatus of claim 6 further comprising:

a knob affixable to the rod distal the bracket.

10. The golf training apparatus of claim 9 wherein the knob is generally spherical.

11. A method of developing a pendulum putting stroke in a golfer comprising the steps of:

affixing a golf training apparatus to a golf putter, the golf training apparatus comprising:

a bracket having a golf club grip attachment side;

a plurality of fingers extending from the golf club grip attachment side and positioned generally at a periphery of the bracket;

a cinch strap wrappable around the fingers to provide securement to a golf club grip; and a rod attachable to and extending perpendicularly from the bracket opposite the golf club grip attachment side;

causing the golfer to grip the golf putter in a conventional manner for putting;

extending the rod to contact a center area of the golfer's stomach while in a preparatory putting position; and causing the golfer to make a putting motion while maintaining the rod's contact with the golfer's stomach.

12. The method of claim 11 wherein the step of affixing further comprises:

moving an at least one movable finger that is slidably attached to the bracket in order to be adjustably spaced from the other of the plurality of fingers.

13. The method of claim 11 wherein the step of affixing further comprises:

wrapping the cinch around the plurality of fingers wherein; the plurality of fingers having a grip contact side and an exterior side, at least one of the plurality of fingers having an eyelet on the exterior side, and the cinch being engagable with the eyelet.

14. A method of developing a chipping swing in a golfer comprising the steps of:

affixing a golf training apparatus to a golf club, the golf training apparatus comprising:

a bracket having a golf club grip attachment side;

a plurality of fingers extending from the golf club grip attachment side and positioned generally at a periphery of the bracket;

a cinch strap wrappable around the fingers to provide securement to a golf club grip; and a rod attachable to and extending perpendicularly from the bracket opposite the golf club grip attachment side;

causing the golfer to grip the golf club in a conventional manner for chipping;

extending the rod to a length past the golfer's elbow while in a preparatory chipping position; and causing the golfer to make a chipping motion while avoiding contacting the rod with the golfer's torso.

15. The method of claim 14 wherein the step of affixing further comprises:

moving an at least one movable finger that is slidably attached to the bracket in order to be adjustably spaced from the other of the plurality of fingers.

16. The method of claim 14 wherein the step of affixing further comprises:

wrapping the cinch around the plurality of fingers wherein the plurality of fingers having a grip contact side and an exterior side, at least one of the plurality of fingers having an eyelet on the exterior side, and the cinch being engagable with the eyelet.

* * * * *